United States Patent [19]

Morgan

[11] Patent Number: 4,961,703

[45] Date of Patent: Oct. 9, 1990

[54] LOAD SHARING FOR PARALLEL FLARES

[75] Inventor: Thomas A. Morgan, Pampa, Tex.

[73] Assignee: Phillips Petroleum Company, Bartlesville, Okla.

[21] Appl. No.: 298,706

[22] Filed: Jan. 19, 1989

[51] Int. Cl.[5] ..... F23D 23/00

[52] U.S. Cl. ..... 431/5; 137/98; 137/251.1; 137/597; 431/202

[58] Field of Search ..... 431/5, 19, 202; 137/98, 137/100, 597, 251.1, 9, 12

[56] References Cited

U.S. PATENT DOCUMENTS

| | | | |
|---|---|---|---|
| 2,205,305 | 6/1940 | Northon | 137/79 |
| 2,267,354 | 12/1941 | Northon | 137/79 |
| 2,581,855 | 1/1952 | Griffith | 137/98 |
| 2,792,070 | 5/1957 | Strunk | 183/2 |
| 2,891,607 | 6/1959 | Webster et al. | 158/99 |
| 3,156,254 | 10/1964 | Stallkamp et al. | 137/253 |
| 3,187,765 | 8/1965 | Frank et al. | 137/253 |
| 3,489,168 | 1/1970 | Joyce et al. | 137/252 |
| 3,592,213 | 7/1971 | Smith | 137/98 |
| 4,563,112 | 1/1986 | Mokuya et al. | 137/110 X |

*Primary Examiner*—Stephen M. Hepperle
*Attorney, Agent, or Firm*—George E. Bogatie

[57] ABSTRACT

A liquid seal valve arrangement is disclosed wherein two liquid seal tanks act in response to a differential pressure to divert a portion of waste gas being directed to a heavily loaded flare to an alternate lightly loaded flare.

11 Claims, 2 Drawing Sheets

LOAD SHARING FOR PARALLEL FLARES

This invention relates to disposal of combustible waste gases. In one aspect it relates to apparatus for equalizing flow of combustible gases between two parallel flares. In another aspect, it relates to a method for effecting load sharing between two parallel flares.

BACKGROUND OF THE INVENTION

It is common practice for refineries to dispose of combustible hydrocarbon containing waste gases by burning the waste gas in a flare. Refineries built to process combustible gases are designed so that the vessels used in the refining process are constructed to withstand normal pressure variations during routine plant operations. However, to prevent rupture of these vessels when actual operating conditions are such that pressures exceed their design pressure limits, safety relief valves are placed on these vessels to vent the high pressure gases. These vented gases can be passed to a flare system where the combustible gases are burned. The high pressure waste gas flow vented to a flare is a primary component of the flare load.

While it is within the capability of one skilled in the art to design a flare stack that will burn combustible gases, such designs generally require that the amount and composition of the waste gases be reasonably constant. In actual refining operations, however, the flow rate of waste gas to a flare is generally not constant, and thus it is often necessary to reduce the flame size and corresponding heat emission from a flare that is highly loaded with waste gases being vented to that flare.

In order to reduce the flame size and/or heat emission from a highly loaded flare stack, it has been proposed to divert a portion of the flow of the waste gas from a highly loaded flare stack to an alternate parallel flare stack that is lightly loaded; however, a simple crossover conduit to connect a heavily loaded flare stack to a lightly loaded flare stack is impractical because an unsealed crossover conduit could result in one flare burner drafting the other flare stack during periods of low flow, thereby creating a backflow by sucking the flames and air back into a flare stack conduit.

In the past it has been proposed to eliminate the backflow condition created by an unsealed crossover conduit between two parallel arranged flare stacks by utilizing pressure controllers which manipulate a butterfly valve in the crossover conduit; however, the control method which manipulates a butterfly valve in the crossover conduit is subject to certain limitations. For example, the waste gas flowing in the crossover conduit could contain contaminants which would foul operation of a butterfly valve and render the utilization of a butterfly valve unreliable. Further, regardless of the contaminants in the waste gas being flared, butterfly valves, especially when used in large sized conduits, are generally unreliable as final control elements. For one example, a butterfly valve requires unequal torque for opening and for closing.

Accordingly, it is an object of this invention to provide improved method and apparatus for diverting a portion of the high pressure waste gas being vented to a flare to an alternate parallel flare if the load of waste gas exceeds a maximum desired load.

It is another object of this invention to provide improved flaring of waste gases by employing liquid seal tanks which are connected to act as valves to effect the diversion of waste gases to an alternate parallel flare stack during periods of high load and which automatically reseals on return to normal loads.

It is a further object of this invention to share a load of waste gas between two parallel arranged flares during periods of high process relief.

It is yet another object of this invention to provide method and apparatus for the venting of waste gases to flare stacks which are safe, economical and reliable.

SUMMARY OF THE INVENTION

In accordance with the present invention, method and apparatus are provided for at least partially equalizing the flow of waste gases to two parallel arranged flares by employing a double liquid seal arrangement in which two seal tanks, and associated conduits, provide cross-coupling flow paths between the flare manifold headers of the flares, when one flare manifold header is heavily loaded.

A portion of the load to a highly loaded flare manifold header is diverted through a crossover conduit to an alternate, lightly loaded flare manifold header during periods of high process relief, and the crossover flow coupling is automatically resealed at normal release rates through the flare manifold headers. Use of the cross-coupling flow conduit between flare manifold headers results in essentially equalizing the load to two parallel flares during periods of high process relief.

In a preferred embodiment, a pair of liquid seal tanks are positioned between two flare manifold headers wherein each flare manifold header provides relief for combustible gases from its own separate refining process. Each seal tank is provided with an elongated relief conduit which extends from one flare manifold header through the top of the seal tank to a position spaced above the bottom of the seal tank. Also each seal tank is provided with a crossover conduit which extends from an upper portion of each seal tank to the parallel flare manifold header. A quantity of seal oil, or other suitable liquid, is disposed within each seal tank, submerging the lower end of the relief conduit to thereby provide an effective valve seal against flow of gases through the relief conduit.

The combination of the crossover conduit and the relief conduit in each seal tank provides a discharge path for the movement of gases between the two flare manifold headers. In the discharge path, the gas is carried by the relief conduit to the top of the seal tank and then downwardly through the seal tank to the lower open end of the relief conduit near the bottom of the seal tank where the gas discharges upwardly through the seal liquid into an annular space defined by the inner surface of the wall of the seal tank and the outer surface of the wall of the relief conduit, and then through the crossover conduit to the parallel flare manifold header. If one flare manifold header becomes highly loaded and increases its actual pressure, compared to the actual pressure of the other flare manifold header, the waste gases under high pressure can pass through the relief conduit, the seal liquid, and the crossover conduit to the lightly loaded flare manifold header via the other relief conduit. If desired, means can be included for adjusting the seal liquid level to compensate for absorption of light end hydrocarbons from the stream passing through the seal liquid, condensation of hot gases as they pass through the seal liquid, or loss of seal liquid during a discharge.

Other objects and advantages of the invention will be apparent from the foregoing brief description of the invention and the claims, as well as the detailed description of the drawings which are briefly described as follows:

DETAILED DESCRIPTION OF THE PREFERRED EMBODIMENT

Figure 1:
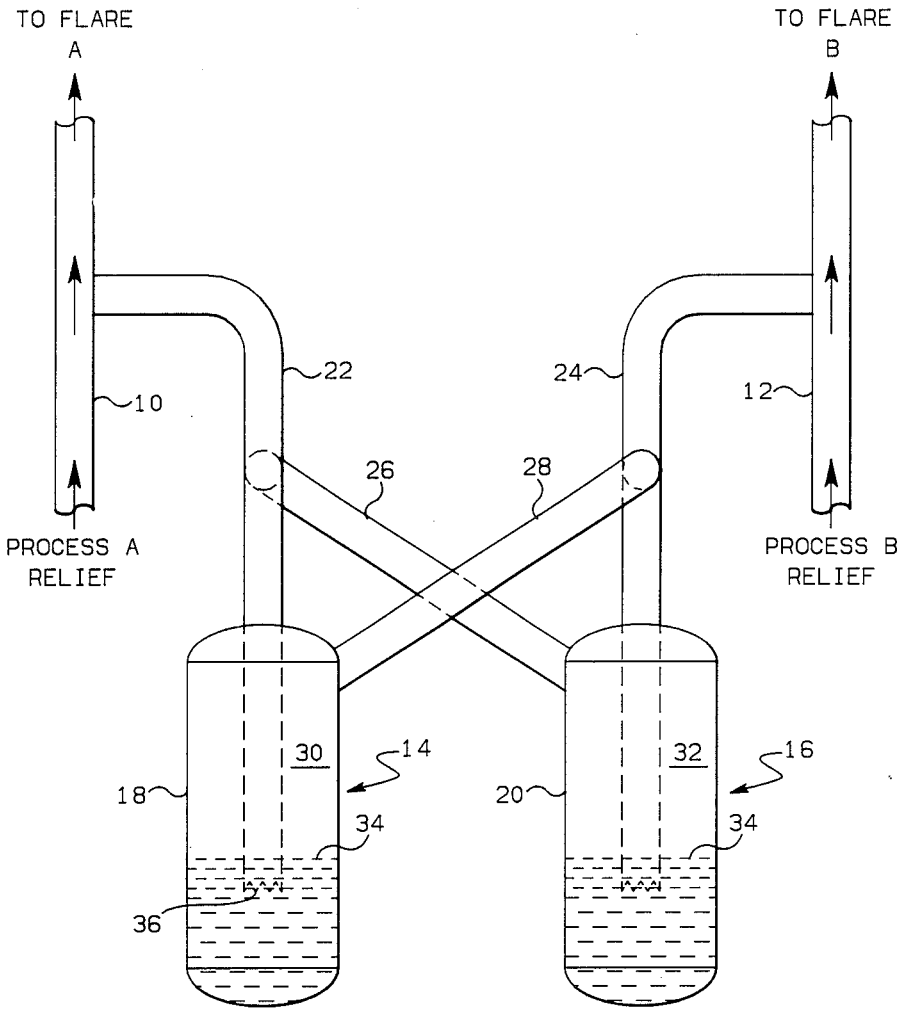
FIG. 1 is a diagrammatic illustration of a crossover coupling in accordance with the present invention between two flare manifold headers, employing liquid seal tanks according to the present invention.

Referring now to FIG. 1, combustible waste gases are delivered from a first refining process to flare A through flare manifold header 10, and from a second refining process to flare B through flare manifold header 12. The gases to be burned in flare A and flare B are waste gases or gases released from process vessels during emergencies and can therefore vary greatly in flow rate, especially during emergency releases.

The flare manifold headers 10 and 12 are cross-coupled through liquid seal tanks 14 and 16, respectively. Each seal tank is defined by upright walls 18 and 20, respectively, and each flare manifold header 10 and 12 is provided with relief conduit means in the form of relief conduits 22 and 24, respectively. Relief conduit 22 extends from manifold header 10 through the top of seal tank 14 and preferably coaxially with the inner surface of the walls 18 of seal tank 14 through a major portion of seal tank 14 to a position wherein the open lower end thereof is spaced above the bottom of seal tank 14 thereby preferably forming a continuous annular space within seal tank 14 defined by the inner surface of the walls 18 of the seal tank 14 and the outer surface of the relief conduit 22. In a similar manner, relief conduit 24 extends from flare manifold header 12 to a position wherein the open lower end thereof is spaced above the bottom of seal tank 16. Crossover conduit means, in the form of crossover conduits 26 and 28, are also provided to carry gases between the flare manifold headers 10 and 12. As illustrated in FIG. 1, crossover conduit 26 is connected in fluid flow communication between the annular space in the upper portion of seal tank 16 and the upper portion of relief conduit 22, and crossover conduit 28 is connected if fluid flow communication between the annular space in the upper portion of seal tank 14 and the upper portion of relief conduit 24.

The flow path for gases to cross over from flare manifold header 10 to flare manifold header 12 is defined by and extends from manifold header 10 downwardly through relief conduit 22 to the open lower end position of relief conduit 22 near the bottom of seal tank 14. This flow path for crossover gases is further defined by and extends through the annular space 30, formed by the walls 18 of seal tank 14 and the portion of relief conduit 22 which extends coaxially into seal tank 14, through crossover conduit 28 and relief conduit 24 to flare manifold header 12. In a similar manner, a second flow path is defined by and extends from manifold header 12 through relief conduit 24, annular space 32 in seal tank 16, through crossover conduit 26 and relief conduit 22 to flare manifold header 10.

In the illustrated embodiment in FIG. 1, each of the seal tanks 14 and 16 is filled with sufficient suitable seal liquid, such as a seal oil having a specific gravity of about 0.75, to a level above the open lower end of the corresponding relief conduit 22 or 24 sufficient to cut off flow of gases between flare manifold headers 10 and 12 are balanced as desired. The relief conduits 22 and 24 may be submerged to any desired depth. For example, if it is desired for relief to occur when the pressure in one flare manifold header, e.g. flare manifold header 12, exceeds the pressure in the other flare manifold header 10 by 0.5 psi, the lower end of relief conduit 24 would be submerged to a depth of 18 inches, if a seal liquid of 0.75 specific gravity were employed.

When operated for the purposes described, if only nominal flow of waste gases through the flare manifold headers 10 and 12 is required such that essentially equal gas pressures exist in flare manifold headers 10 and 12, seal tanks 14 and 16 act as closed valves, blocking any flow of gases through the crossover conduits 26 and 28.

Figure 2:
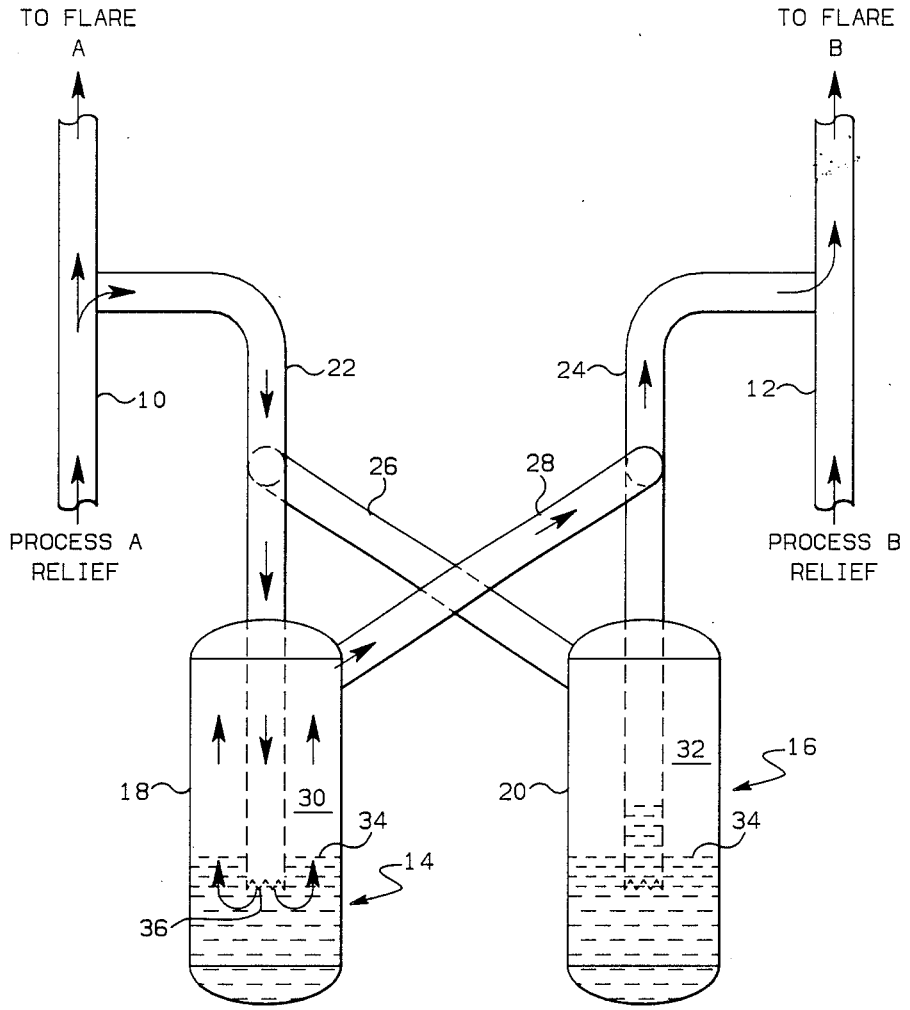
FIG. 2 is a diagrammatic illustration of the crossover coupling of FIG. 1 showing the fluid levels in the seal tanks during a period of high volume process relief.

Now, for example, consider that the seal tank 18 is charged with a quantity of 0.75 specific gravity seal oil and the liquid level 34 is 18 inches above the open lower end 36 of relief conduit 22. If then one of the flare manifold headers, e.g., flare manifold header 10 becomes excessively loaded such that the pressure in relief conduit 22 is 0.5 psi greater than the pressure in relief conduit 24, waste gases from flare manifold header 10 will blow through the liquid seal in tank 14, through the annular space 30, crossover conduit 28, relief conduit 24, and flare manifold header 12, to flare B. In this situation, which is illustrated in FIG. 2, the seal tank 14 acts as an open valve and seal tank 16 acts as a closed valve during a period of high loading in flare manifold header 10. On return to normal differential pressure between flare manifold headers 10 and 12, the crossover flow path is automatically resealed and both seal tanks 14 and 16 again act as closed valves.

The invention has been described in terms of the presently preferred embodiment wherein venting of combustible waste gases to a flare system is illustrated in FIGS. 1 and 2. It is to be understood, however, that reasonable variations and modifications are possible by those skilled in the art. For example, the type and arrangement of liquid seal tanks described would be equally applicable to disposal of waste gases in a ground flare, an incinerator, a furnace or a burning pit, and such modifications are within the scope of the described inventions and the appended claims.

That which is claimed is:

1. Apparatus comprising:

first manifold header means for transporting combustible waste gases from a first process to a first flare;

second manifold header means for transporting combustible waste gases from a second process to a second flare;

first conduit means for establishing a first flow path from said first manifold header means to said second manifold header means;

second conduit means for establishing a second flow path from said second manifold header to said first manifold header means;

means for sealing said first flow path and said second flow path when actual pressure in said first manifold header means and actual pressure in said second manifold header means are essentially equal; and means for connecting said first manifold header means to said second manifold header means through said first flow path and for sealing said second flow path when the actual pressure in said first manifold header means is greater than the actual pressure in said second manifold header means by a first predetermined amount, and, alternately, for connecting said second manifold header means to said first manifold header means through said second flow path and for sealing said first flow path when the actual pressure in said second manifold header means exceeds the actual pressure in said first manifold header means by a second predetermined amount.

2. Apparatus in accordance with claim 1 wherein said first conduit means comprises:

a first vessel having a top, a bottom, and an inner surface;

first relief conduit means having a lower end and extending from said first manifold header means through the top of said first vessel and downwardly through said first vessel with the lower end thereof positioned at a point above the bottom of said first vessel for forming a space within said first vessel between said first relief conduit means and said inner surface of said first vessel; and first crossover conduit means for providing fluid communication from said space in said first vessel to said second manifold header means.

3. Apparatus in accordance with claim 2 wherein said second conduit means comprises:

a second vessel having a top, a bottom, and an inner surface;

second relief conduit means having a lower end and extending from said second manifold header means through the top of said second vessel and downwardly through said second vessel with the lower end thereof positioned at a point above the bottom of said second vessel for forming a space within said second vessel between said second relief conduit means and said inner surface of said second vessel, and second crossover conduit means for providing fluid communication from said space in said second vessel to said first manifold header means.

4. Apparatus in accordance with claim 3 wherein said means for sealing said first flow path comprises a first quantity of liquid seal oil contained in said first vessel so that the lower end of said first relief conduit means located in said first vessel is submerged in said first quantity of liquid seal oil to a predetermined depth.

5. Apparatus in accordance with claim 4 wherein said means for sealing said second flow path comprises a second quantity of liquid seal oil contained in said second vessel so that the lower end of said second relief conduit means located in said second vessel is submerged in said second quantity of liquid seal oil to a predetermined depth.

6. Apparatus in accordance with claim 1 additionally comprising:

a first flare connected in fluid flow communication to said first manifold header means; and a second flare connected in fluid flow communication to said second manifold header means.

7. A method for effecting load-sharing between a first flare and a second flare wherein a first manifold header transports combustible waste gases from a first process to said first flare, and a second manifold header transports combustible waste gases from a second process to said second flare, said method comprising the steps of:

establishing a first flow path from said first manifold header to said second manifold header and establishing a second flow path from said second manifold header to said first manifold header;

sealing said first flow path and said second flow path when the actual pressures in said first manifold header and in said second manifold header are essentially equal;

connecting said first manifold header to said second manifold header through said first flow path and sealing said second flow path when the actual pressure in said first manifold header is greater than the actual pressure in said second manifold header by a predetermined amount; and connecting said second manifold header to said first manifold header through said second flow path and sealing said first flow path when the actual pressure in said second manifold header is greater than the actual pressure in said first manifold header by a predetermined amount.

8. A method in accordance with claim 7 wherein a first vessel and a second vessel, each having a top and a bottom and an inner surface, are associated respectively with said first manifold header and said second manifold header and wherein said step of establishing a first flow path comprises:

providing a first relief conduit having a lower end and extending from said first manifold header to a point within and with the lower end thereof positioned above the bottom of said first vessel, wherein said first relief conduit is positioned with respect to said first vessel so as to form a space within said first vessel between said first relief conduit and the inner surface of said first vessel; and providing a first crossover conduit for fluid communication from said space within said first vessel to said second manifold header.

9. A method in accordance with claim 8 wherein said step of establishing a second flow path from said second manifold header to said first manifold header comprises:

providing a second relief conduit having a lower end and, extending from said second manifold header to a point within and with the lower end thereof positioned above the bottom of said second vessel, wherein said second relief conduit is positioned with respect to said second vessel so as to form a space within said second vessel between said second relief conduit and the inner surface of said second vessel; and providing a second crossover conduit for fluid communication from said space within said second vessel to said first manifold header.

10. A method in accordance with claim 9 wherein said step of sealing said first flow path comprises submerging the lower end of said first relief conduit in a quantity of liquid in said first vessel.

11. A method in accordance with claim 10 wherein said step of sealing said second flow path comprises submerging the lower end of said second relief conduit, in quantity of liquid in said second vessel.

* * * * *